US006397902B1

(12) United States Patent
Murphy

(10) Patent No.: US 6,397,902 B1
(45) Date of Patent: Jun. 4, 2002

(54) HIGH SPEED NOZZLE WITH VAPOR RECOVERY

(76) Inventor: Michael J. Murphy, 3048 Root Ave., Carmichael, CA (US) 95608

( * ) Notice: Subject to any disclaimer, the term of this patent is extended or adjusted under 35 U.S.C. 154(b) by 0 days.

(21) Appl. No.: 09/843,549

(22) Filed: Apr. 25, 2001

(51) Int. Cl.[7] ..... B65B 31/00

(52) U.S. Cl. ..... 141/59; 141/286; 141/290; 141/291; 141/301; 141/351; 141/352; 141/353

(58) Field of Search ..... 141/2, 4, 7, 59, 141/94, 192, 198, 285, 286, 290, 291, 301, 351–354

(56) References Cited

U.S. PATENT DOCUMENTS

| | | | | |
|---|---|---|---|---|
| 2,723,070 A | | 11/1955 | Merriam | |
| 3,181,576 A | | 5/1965 | Pellerino | |
| 3,799,222 A | | 3/1974 | Franz | |
| 4,667,710 A | | 5/1987 | Wu | |
| 4,834,151 A | | 5/1989 | Law | |
| 4,924,921 A | * | 5/1990 | Simmel et al. | 141/286 |
| 5,076,333 A | | 12/1991 | Law | |
| 5,249,611 A | | 10/1993 | Law | |
| 5,406,994 A | | 4/1995 | Mitchell | |
| 5,419,378 A | | 5/1995 | Law | |
| 5,507,328 A | | 4/1996 | Donovan | |
| 5,829,491 A | * | 11/1998 | Bennett | 141/59 |

* cited by examiner

*Primary Examiner*—Timothy L. Maust
(74) *Attorney, Agent, or Firm*—Heisler & Associates

(57) ABSTRACT

A nozzle is provided which includes a nozzle body having a proximal end and an insertion end and defining an inlet orifice at the proximal end thereof and an outlet orifice at the insertion end thereof. The nozzle body is adapted to be attached at the proximal end thereof to an opening of a container and to be inserted at the insertion end thereof into an opening of a receiving vessel for dispensing a first fluid from the container into the receiving vessel from the inlet orifice to the outlet orifice thereof. The nozzle further includes a venting device connected to the nozzle body and defining a vent discharge opening for venting a second fluid from the receiving vessel into the container through the vent discharge opening such that the second fluid is vented through the vent discharge opening of the venting device without traversing the first fluid in the container substantially during an entire time for a dispensing of the first fluid from the container into the receiving vessel.

7 Claims, 3 Drawing Sheets

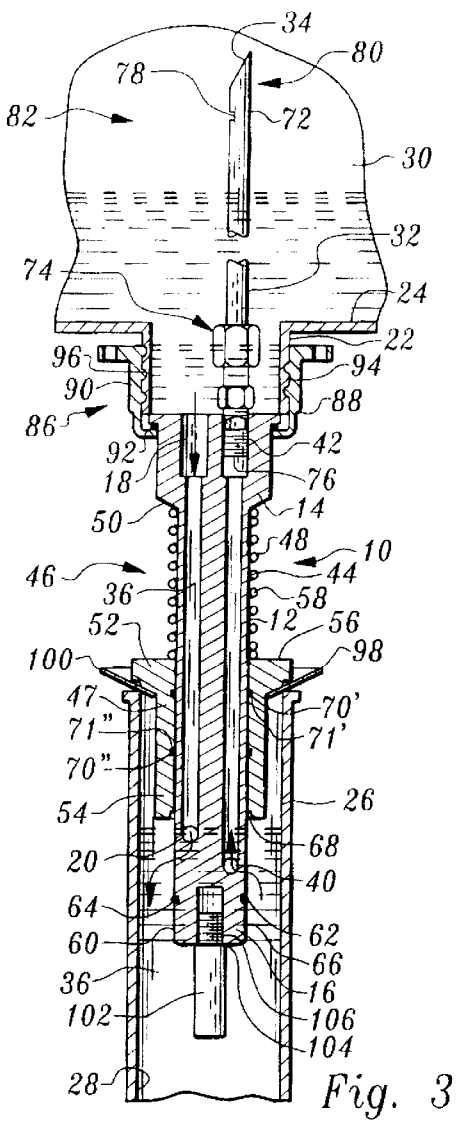
Fig. 1
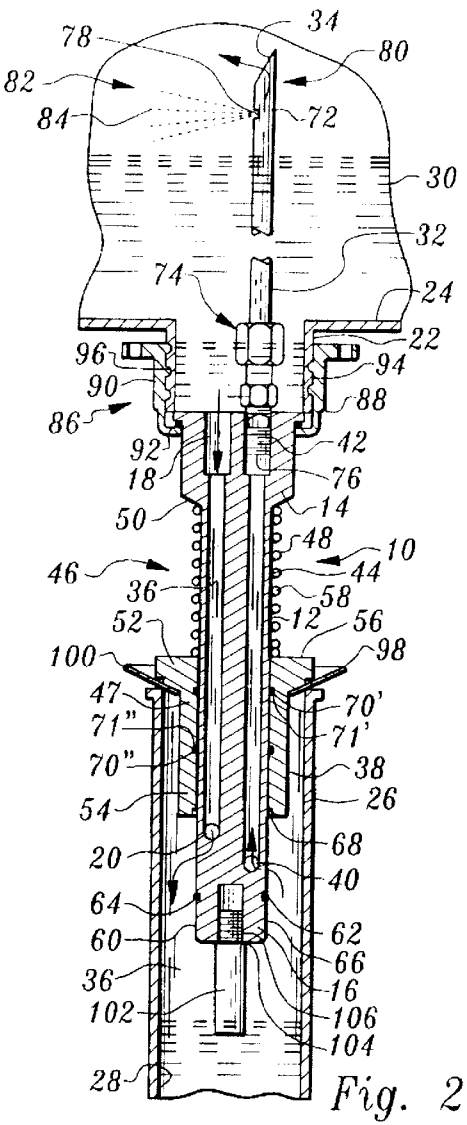
Fig. 2
Fig. 3

102
106
62
108
98
68
54
47
38
56
52
70"
70'
58
86
90
92
104
16
60
20
40
12
50
14
88
74
32
72
34

HIGH SPEED NOZZLE WITH VAPOR RECOVERY

FIELD OF THE INVENTION

This invention generally relates to nozzles for containers of fluid, and more particularly to nozzles that permit transfers of the fluid under the influence of gravity into a receiving vessel without the risk of spills, overflow or vapor escape.

BACKGROUND OF THE INVENTION

Nozzles of the general type described above are known in the art. These prior art nozzles generally have, as one objective, to minimize spills or splashes while they are dispensing fluid from a portable container into a receiving vessel (i.e. a fuel tank) while at the same time stopping the flow of fluid when the receiving vessel is full. Examples of such nozzles are provided in U.S. Pat. No. 2,723,070, U.S. Pat. No. 3,181,576, U.S. Pat. No. 3,799,222, U.S. Pat. No. 4,667,710, U.S. Pat. No. 4,834,151, U.S. Pat. No. 5,076,333, U.S. Pat. No. 5,249,611, U.S. Pat. No. 5,406,994, U.S. Pat. No. 5,419,378, U.S. Pat. No. 5,507,328 the contents of which are incorporated herein by reference.

There are numerous instances where a receiving vessel or tank must be filled with a fluid. Typically, in such instances, it is necessary that spills and vapor release be minimized or totally eliminated by virtue of the environment where the dispensing is accomplished or by virtue of the fluid being dispensed, such as where fuel is being dispensed into the fuel tanks of lawn mowers, chain saws, tractors, motorized recreational vehicles, outboard motors, personal water craft and other fuel-powered machinery. In such instances, it is undesirable that any fuel should be spilled or vapor released, given the posed health and environmental hazards associated with such spills.

Spills occur in a variety of circumstances. For instance, containers of fluid must usually be tilted toward the receiving vessel with their opening pointing downward in order for fluid to be dispensed. Spills are not uncommon during such tilting. Additionally, spills tend to occur when the receiving vessel becomes full and overflows. This is especially true because, if an automatic stop mechanism is not provided on the nozzle, it is difficult to see when the receiving vessel has been actually filled. Moreover, the improper venting of the portable container can also contribute to spills. For instance, improper venting can result in an uneven flow of fluid including surges of flow, making impossible a reliable prediction of the fluid level in the receiving vessel, tending to cause splashes, and generally resulting in turbulence in the container that makes it difficult to hold the container steady.

Although the prior art has, up till now, attempted to address the above problems, it has, however, failed to offer a nozzle that effectively prevents spills and overflow of the receiving vessel while at the same time advantageously having a simple and effective configuration allowing a speedy dispensing of fluid from a container into the receiving vessel.

SUMMARY OF THE INVENTION

The invention provides a nozzle including a nozzle body having a proximal end and an insertion end and defining an inlet orifice at the proximal end thereof and an outlet orifice at the insertion end thereof. The nozzle body is adapted to be attached at the proximal end thereof to an opening of a container and to be inserted at the insertion end thereof into an opening of a receiving vessel for dispensing a first fluid from the container into the receiving vessel from the inlet orifice to the outlet orifice thereof. The nozzle further includes a vapor/air venting device connected to the nozzle body and defining a vent discharge opening for venting a second fluid (typically a gaseous fluid such as fuel vapor or air) from the receiving vessel into the container through the vent discharge opening. The second fluid is vented through the vent discharge opening of the venting device without traversing the first fluid in the container substantially during an entire time for dispensing of the first fluid from the container into the receiving vessel.

The nozzle further comprises a valve head disposed at the insertion end of the nozzle body for selectively opening and closing the outlet orifice of the nozzle body. The valve head includes a flexible seal adapted to be compressed to sealingly abut against walls of the opening of the receiving vessel when the nozzle body is inserted into the opening of the receiving vessel for substantially preventing at least the second fluid (i.e. vapor/air/volatile organic compounds or VOCs) from escaping at the opening of the receiving vessel.

The invention further provides a method for using the nozzle as described above, the method comprising the steps of dispensing a first fluid from a container into a receiving vessel; and venting a second fluid from the receiving vessel into the container such that the second fluid is vented into the receiving vessel without traversing the first fluid in the container substantially during an entire time for a dispensing of the first fluid from the container into the receiving vessel.

Additionally, the invention provides a kit for forming a nozzle. The kit includes a nozzle body having a proximal end and an insertion end and defining an inlet orifice at the proximal end thereof, an outlet orifice at the insertion end thereof, the nozzle body further being adapted to be attached at the proximal end thereof to an opening of a container and to be inserted at the insertion end thereof into an opening of a container for dispensing a first fluid from the container into the receiving vessel from the inlet orifice to the outlet orifice. The kit further includes a venting device adapted to be connected to the nozzle body and defining a vent discharge opening for venting a second fluid from the receiving vessel into the container through the vent discharge opening such that the second fluid is vented through the vent discharge opening of the venting device without traversing the first fluid in the container substantially during dispensing of the first fluid from the container into the receiving vessel.

Furthermore, the invention provides a combination comprising a container defining an opening, and a nozzle attached to the container at the opening thereof. The nozzle comprises a nozzle body having a proximal end and an insertion end and defining an inlet orifice at the proximal end thereof and an outlet orifice at the insertion end thereof, the nozzle body further being attached at the proximal end thereof to the opening of the container and to be inserted at the insertion end thereof into an opening of a receiving vessel for dispensing a first fluid from the container into the receiving vessel from the inlet orifice of the nozzle body to the outlet orifice of the nozzle body. The nozzle further comprises a venting device connected to the nozzle body and defining a vent discharge opening for venting a second fluid from the receiving vessel into the container through the vent discharge opening such that the second fluid is vented through the vent discharge opening of the venting device without traversing the first fluid in the container (i.e. without needing to bubble up through a substantial portion of the first fluid) substantially during an entire time for a dispensing of the first fluid from the container into the receiving vessel.

The invention additionally provides a nozzle comprising means for dispensing a first fluid from a container into a receiving vessel; and means for venting a second fluid from the receiving vessel into the container such that the second fluid is vented into the receiving vessel without traversing the first fluid in the container substantially during an entire time for a dispensing of the first fluid from the container into the receiving vessel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a cross sectional view of the nozzle and container combination of this invention depicting the nozzle as having been inserted into the opening of a receiving vessel;

FIG. 2 is a view similar to FIG. 1, depicting the valve head as having been slid back to open the outlet orifice and vent inlet orifice of the nozzle for dispensing fluid between the container and the receiving vessel;

FIG. 3 is a view similar to FIGS. 1 and 2, showing the fluid level in the receiving vessel as having reached the vent inlet orifice of the nozzle body for shutting off the supply of fluid into the receiving vessel;

DESCRIPTION OF THE PREFERRED EMBODIMENT

Figure 4:
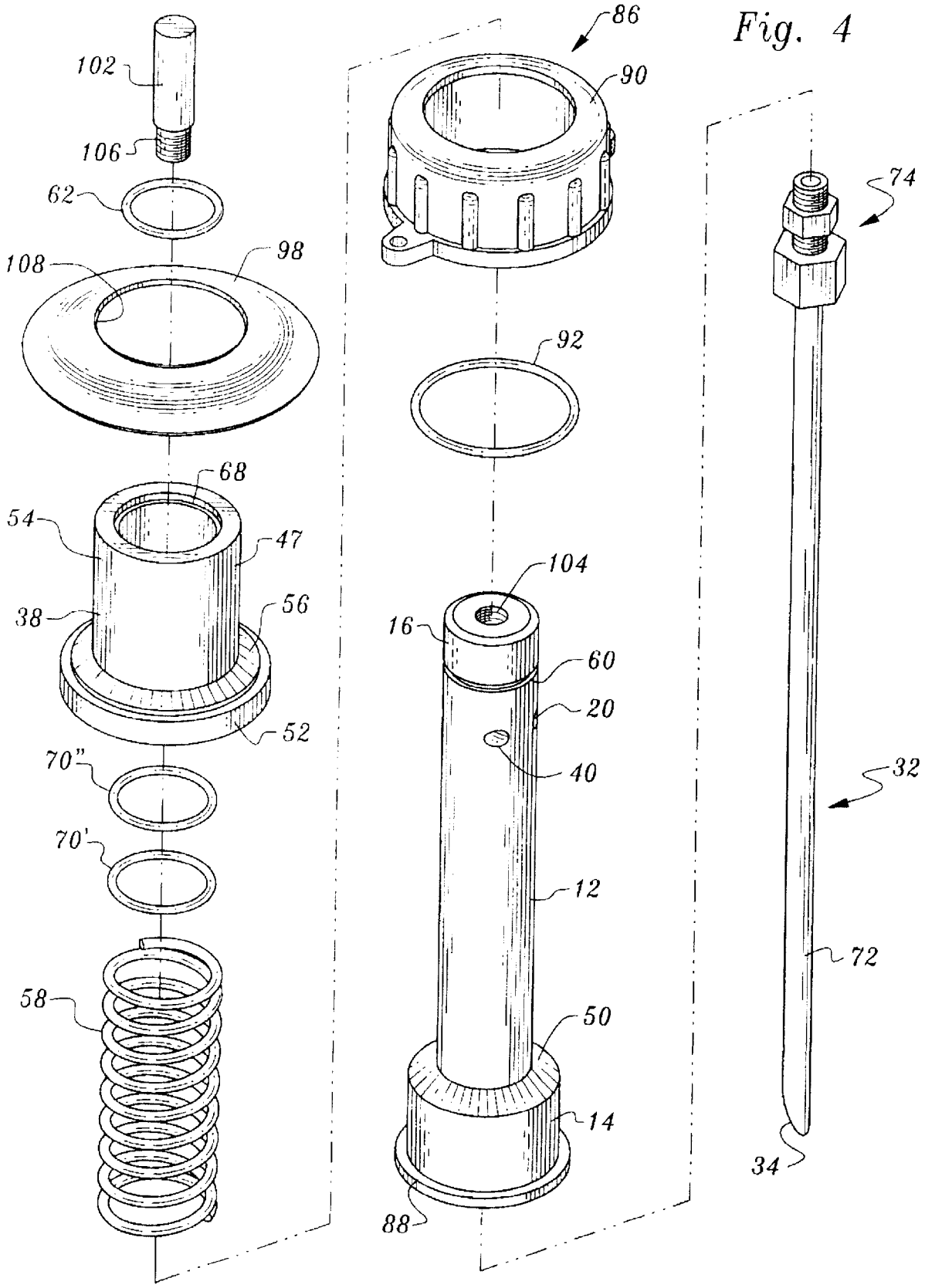
FIG. 4 is an exploded view of a kit for making a preferred embodiment of the nozzle according to the present invention.

According to the present invention, a nozzle is provided allowing the dispensing a first fluid from a portable container into a receiving vessel. The nozzle also allows the venting of a second fluid from the receiving vessel into the portable container. The second fluid is vented from the receiving vessel into the portable container without traversing the first fluid in the container substantially during dispensing of the first fluid from the container into the receiving vessel. According to the present invention, the first fluid may be a liquid, such as a liquid hydrocarbon fuel, and the second fluid may be a gas such as air and fuel vapors. The portable container may further be a can of fuel and the receiving vessel a fuel tank. The invention encompasses within its scope the use of a nozzle with any containers, receiving vessels and/or fluids that would allow the operation of the nozzle as described above.

Turning now to the drawings, and, more particularly, to FIGS. 1, 2 and 3, the present invention provides, as shown in the combination of nozzle and receiving vessel according to a preferred embodiment of the present invention, a nozzle 10 including a nozzle body 12 having a proximal end 14 and an insertion end 16. An inlet orifice 18 is provided at the proximal end 14 thereof and an outlet orifice 20 at the insertion end thereof. The nozzle body 12 is further shown as having been attached at the proximal end 14 thereof to an opening 22 of a container 24 and as having been inserted at the insertion end 16 thereof into an opening 26 of a receiving vessel 28 (such as a pipe leading to a fuel tank) for dispensing a first fluid 30 from the container 24 into the receiving vessel 28 from the inlet orifice 18 to the outlet orifice 20 thereof.

A venting device 32 is connected to the nozzle body 12 and defines a vent discharge opening 34 for venting a second fluid 36 from the receiving vessel 28 into the container 24 through the vent discharge opening 34 such that the second fluid is vented through the vent discharge opening of the venting device without traversing the first fluid 30 in the container substantially during dispensing of the first fluid from the container into the receiving vessel. For maximum benefit, the vent discharge opening 34 is deep within the container 24 and spaced from the proximal end 14 of the nozzle body 12 a distance similar to a depth of the container when inverted for emptying. However, some benefit is still obtained with the vent discharge opening 34 closer to but still spaced from the nozzle body 12, with this spacing preferably more than half the distance from the container opening to an opposite wall. In this way, the benefits of keeping the second fluid separate from the first fluid are provided for a majority of the time that the container is being emptied. Advantageously, such an arrangement of the venting device allows a speedy venting of the second fluid into the container, this way reducing dispensing time and further providing a smooth delivery of the first fluid into the receiving vessels substantially without surges or appreciable turbulence associated with requiring the second fluid 36 to "bubble up" through the first fluid 30 within the container 24.

The nozzle body 12 preferably defines a pathway 36 therein between the inlet orifice 18 and the outlet orifice 20 for dispensing the first fluid from the container 24 into the receiving vessel 28 through the pathway 36. A valve head 38 is shown as having been disposed at the insertion end 16 of the nozzle body 12 for selectively opening and closing the outlet orifice 20 and a vent inlet orifice 40 of the nozzle body 12. Vent inlet orifice 40 is at the proximal end 16 of the nozzle body 12, the nozzle body 12 further being configured for allowing the second fluid 36 to be vented from the receiving vessel 28 to the container 24 from the vent inlet orifice 40 of the nozzle body 12 to the vent discharge opening 34 of the venting device 32. The nozzle body 12 further defines a vent outlet orifice 42 and a pathway 44 therein between the vent inlet orifice 40 and the vent outlet orifice 42 for dispensing the second fluid 36 from the receiving vessel 28 into the container 24 through the pathway 44. Preferably, the vent inlet orifice 40 is disposed closer to the insertion end 16 of the nozzle body 12 than the outlet orifice 42. It is noted that, while the preferred embodiment of the present invention shown in the figures depicts a single outlet orifice and a single outlet orifice for the first fluid, and a single vent discharge opening and a single vent inlet orifice for the second fluid, the present invention includes within its scope the provision of a plurality of each of the above orifices and of a plurality of vent discharge openings depending on application needs.

Preferably, the valve head 38 comprises a retractable cover mechanism 46 including a retractable cover 47 in the form of a sleeve telescopingly disposed over the nozzle body 12 to slidingly cover and uncover the outlet orifice 20 and the vent inlet orifice 40 of the nozzle body 12 for selectively closing and opening each of the outlet orifice 20 and the vent inlet orifice 20. The retractable cover mechanism 46 according to the present invention can take any form in order to allow the selective covering and uncovering of the orifices of the nozzle body 12 as described above, in a manner that would be readily recognized by one skilled in the art. Preferably, the retractable cover mechanism 46 according to the present invention comprises a biasing mechanism 48 disposed to bias the retractable cover 47 in a default mode thereof to close the outlet orifice 20 and the vent inlet orifice 40 of the nozzle 10 by covering the outlet orifice 20 and the vent inlet orifice 40 of the nozzle body 12. The biasing mechanism 48 is further actuatable to effect a sliding of the cover 47 into an actuated mode thereof to open the outlet orifice 20 and the vent inlet orifice 40 of the nozzle 10. The default mode of the retractable cover 47, as described above and as shown in FIG. 1, advantageously prevents any spilling or leaking of the first fluid 30 out of the container 24 when the container is being tilted and before the nozzle 10, including the outlet orifice 20 of the nozzle body 12 and the vent inlet orifice 40 thereof, are inserted into the opening 26 of the receiving vessel 28. Substantially no amount of the first fluid 30 emerges from the nozzle 10 until the insertion end 16 of the nozzle body 12 is in the opening 26, and until the retractable cover 47 has been actuated, as shown in FIG. 2, by pressing against the opening 26 and compressing the biasing mechanism 48, to expose and open the outlet orifice 20 and vent inlet orifice 40 of the nozzle body within receiving vessel 28.

According to a more preferred embodiment of the present invention, the retractable cover mechanism 46 operates through cooperation with corresponding structural configurations of the nozzle body 12. In particular, as shown in FIGS. 1, 2 and 3, the nozzle body 12 defines a reference step 50 at the proximal end 14 thereof, and the retractable cover 47 has a first end 52 and a second end 54 and further defines a reference step 56 at the first end 52 thereof. The biasing mechanism 48 comprises a helical compression spring 58 abutting, at one end thereof, the reference step 50 of the nozzle body 12, and at another end thereof the reference step 56 of the retractable cover 47 for providing a compliant preload between the nozzle body 12 and the retractable cover 47. The function of the compliant preload provided by compression spring 58 is to urge, in a default state thereof, the retractable cover 47 to cover the outlet orifice 20 and vent inlet orifice 40 of the nozzle body 12 and to be compliant for being compressed, as shown in FIG. 2, to open the above orifices.

More preferably, the nozzle body defines at the insertion end 16 thereof an annular recess 60 for receiving an O-ring 62 therein. O-ring 62 is part of the retractable cover mechanism 46, and has an outer perimeter 64, as best seen in FIGS. 2 and 3, and is disposed in the annular recess of 60 the nozzle body 12 such that the outer perimeter thereof juts out from an outer surface 66 of the nozzle body 12. Moreover, the retractable cover 47 preferably defines an O-ring step 68 at the first end thereof, the O-ring step being adapted to abut against the outer perimeter 64 of the O-ring when the retractable cover is in its default mode as shown in FIG. 1, the outer perimeter 64 of the O-ring thereby providing a stop element against a further advance of the retractable cover 47 toward the insertion end 16 of the nozzle body.

According to a further preferred aspect of the present invention, the retractable cover mechanism 46 further comprises O-rings 70' and 70", and the retractable cover 47 defines corresponding annular recesses 71' and 71" therein, each respective O-ring being disposed in a corresponding one of the recesses of the retractable cover. While the figures show two O-rings 70' and 70", it is noted that the invention includes within its scope the use of one or any other number of O-rings as described above. The O-rings 70' and 70" stabilize the retractable cover 47 on the nozzle body 12 and provide a seal for substantially preventing the fluids from escaping from the container 24 or the receiving vessel 28 through the retractable cover 47. The second fluid 36, such as air or fuel vapors or a mixture of both could possibly escape from the receiving vessel 28 once the nozzle has been inserted into the opening 26 thereof, the escape occurring among other places through the annular space existing between the sleeve valve or retractable cover 47 and the exterior surface 66 of nozzle body 12. Escape of the second fluid from this annular space, however, is substantially prevented through the use of one or more O-rings or other seals, such as O-rings 70' and 70". O-rings 70' and 70" further act as guides in the above annular space for the retractable cover 47, in particular during its movement from its default position as shown in FIG. 1 into its actuated position as shown in FIG. 2. While the O-rings 70' and 70" are shown set in grooves in the retractable cover 47, they could alternatively be set in grooves in the nozzle body 12.

According to a further, preferred embodiment of the present invention, the venting device 32 comprises an elongated tube 72, the tube preferably having at one end thereof a fastening mechanism 74 adapted to fasten the tube 72 to the vent outlet orifice 42 of the nozzle body 12. Fastening mechanism 74 may take any suitable form, such as, in the preferred form thereof, that of a threaded bolt configured to be threaded into a corresponding threaded neck portion 76 of the vent outlet opening 42 of nozzle body 12. Preferably, the venting device 32 includes a sound generating mechanism 78 at the tip 80 thereof adapted to generate a sound during a venting of the second fluid into the container, as suggested by way of example in FIG. 2. The sound generating mechanism may, according to the present invention, take any form, as readily recognizable by one skilled in the art. Preferably, the sound generating mechanism 78 comprises a whistle 82 for generating a sound by virtue of at least a portion 84 of the second fluid being vented into the container through the whistle 82, as seen in FIG. 2. Advantageously, the whistle 82 allows an audible indication of dispensing time for the first fluid, the halting of the audible indication signaling the user to remove the nozzle 10 from the opening 26 of the receiving vessel 28. As seen in the figures, the vent discharge opening 34 is defined at the tip 80 of the elongated tube, the tip further being non-perpendicular with respect to a centerline of the elongated tube, as best seen in FIGS. 1, 2 and 3. The provision of a tip at which the vent discharge opening is defined and which is non-perpendicular to the tube center line as described above advantageously allows the elongated tube 72 to be placed in the container such that, even where the tip 80 is disposed adjacent a wall of the container, a discharge of the second fluid is substantially ensured.

According to a preferred embodiment, the nozzle 10 according to the present invention further includes an attachment mechanism 86 coupled to the nozzle body 12 for attaching the nozzle body 12 to the opening 22 of the container 24. The attachment mechanism 86 according to the present invention may take any suitable form, as readily recognizable by one skilled in the art. Preferably, the attachment mechanism 86 is configured for sealingly attaching the nozzle body 12 to the opening 22 of the container 24 for substantially preventing the first fluid 30 and the second fluid 36 from escaping at the opening 22 of the container 24. For effecting the above sealing attachment, preferably, the proximal end 14 of the nozzle body 12 defines a flange 88, and the attachment mechanism 86 comprises a cap ring 90 and a cap ring seal 92. The cap ring 90 is preferably threaded on inner walls 94 thereof for attachment to corresponding threads 96 on the opening 22 of the container 24. As seen in FIGS. 1 through 3, the cap ring seal 92 abuts at one side thereof against the cap ring 90 and on another side thereof against the flange 88 of the proximal end 14 of the nozzle body 12, the cap ring seal and the cap ring being effective for providing a sealed attachment of the nozzle 10 to the opening 22 of the container 24 for substantially preventing the first fluid 30 and the second fluid 36 from escaping at the opening 22 of the container 24.

Preferably, the valve head is configured for a sealing insertion thereof into the opening 26 of the receiving vessel 28 for substantially preventing at least the second fluid 36 from escaping at the opening 26 of the receiving vessel 28. For effecting the above result, the valve head preferably includes a flexible seal 98, preferably made of rubber, and adapted to be compressed as seen in FIGS. 1 through 3 and in FIG. 6, to sealingly abut against walls of the opening 26 of the receiving vessel 28 for substantially preventing at least the second fluid 36 from escaping at the opening 26 of the receiving vessel 28. As depicted in the figures, the seal 98 is preferably generally conical, with its wide portion 100 oriented toward the proximal end 14 of the nozzle body 12. The seal 98 thus rests against the first end 52 of the cover 47 and seals with the opening 26 before the cover 47 is retracted and fluid transfer commences.

Preferably, a tip element 102 is disposed at the insertion end 16 of the nozzle body 12, the tip element 102 being configured for advantageously pushing open a covering of the opening of the receiving vessel when the nozzle body is being inserted therein (i.e. pushing open a vapor valve on an automotive fuel tank fill pipe). More preferably, tip element may be threaded into the insertion end 16 of the nozzle body 12 as shown, such as through a threaded portion 106 on the tip element engaging a corresponding threaded neck hole 104 of the nozzle body 12.

Referring now to FIG. 4, an exploded view of the nozzle 10 according to the present invention is provided. The exploded view depicts the nozzle 10 as having been taken apart, and essentially represents a kit for forming a nozzle 10 according to the preferred embodiment of the present invention depicted in FIGS. 1, 2 and 3. The kit according to the present invention includes the nozzle body 12 including proximal end 14 and insertion end 16, and defining the inlet orifice 18 (FIG. 1) at the proximal end 14 thereof and the outlet orifice 20 at the insertion end 16 thereof. The nozzle body 12 is adapted to be attached at the proximal end 14 thereof to the opening 22 of the container 24 and to be inserted at the insertion end 16 thereof into an opening 26 of a receiving vessel 28 for dispensing a first fluid 30 from the container 24 into the receiving vessel 28 from the inlet orifice 18 to the outlet orifice 20.

The kit further includes the venting device 32 adapted to be connected to the nozzle body 12, such as by fastening mechanism 74, and defining the vent discharge opening 34 for venting the second fluid 36 from the receiving vessel 28 into the container 24 through the vent discharge opening 34 such that the second fluid 36 is vented through the vent discharge opening 34 of the venting device 32 without traversing the first fluid 30 in the container 24 substantially during an entire time for a dispensing of the first fluid 30 from the container 24 into the receiving vessel 28. Preferably the kit further includes the valve head 38 including the retractable cover 47 adapted to be disposed at the insertion end 16 of the nozzle body 12 for selectively opening and closing the outlet orifice 20. More preferably, the nozzle 10 includes the attachment mechanism 86 adapted to be connected to the nozzle body 12 for attaching the nozzle body 12 to the opening 22 of the container 24.

As seen in FIG. 4, the complete kit according to the preferred embodiment of the present invention comprises the venting device 32, including elongated tube 72 defining vent discharge opening 34 at the tip thereof, and including fastening mechanism 74. The nozzle body 12 further defines a flange 88 at the proximal end 14 thereof for supporting O-ring 92 thereon, and an annular recess 60 at the insertion end 16 thereof for receiving O-ring 62 therein. The insertion end 16 of the nozzle body 12 further defines the threaded opening 104 therein for receiving the corresponding threaded end portion 106 of tip element 102 therein for attaching the tip element to the nozzle body, and a reference step 50 for the compression spring 58. The retractable cover mechanism includes retractable cover 47 having first end 52 and second end 54, and further defining an O-ring step 68 for O-ring 62, and the reference step 56. Additionally, the two O-rings 70' and 70" are adapted to be received in corresponding grooves (FIG. 1) in the retractable cover 47. Seal 98 additionally is adapted to be received on reference surface 56 of retractable cover 47, and to receive the cover 47 in a central opening 108 thereof. The kit as shown in FIG. 4, when assembled, would yield the nozzle 10 according to the preferred embodiment of the present invention as depicted in FIGS. 1 through 3.

In operation, the preferred embodiment of the nozzle 10 according to the present invention is used by dispensing the first fluid 30 from the container 24 into the receiving vessel 28, and by venting the second fluid 36 from the receiving vessel 28 into the container 24, such that the second fluid 36 is vented into the container 24 without traversing the first fluid 30 in the container 24 substantially during dispensing of the first fluid 30 from the container 24 into the receiving vessel 28.

Figure 6:
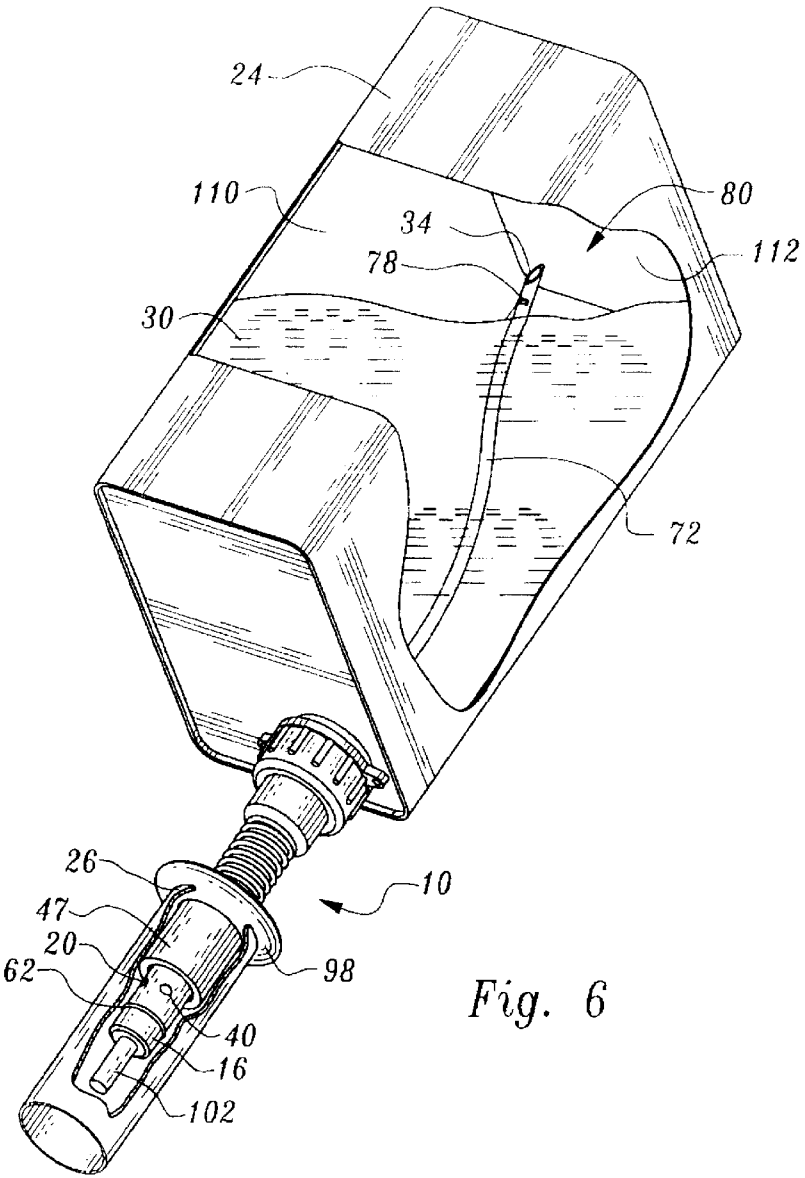
FIG. 6 is a view similar to FIG. 5, depicting the container as having been titled and the nozzle as having been inserted into the opening of a receiving vessel for dispensing fluid from the container into the receiving vessel.
Figure 5:
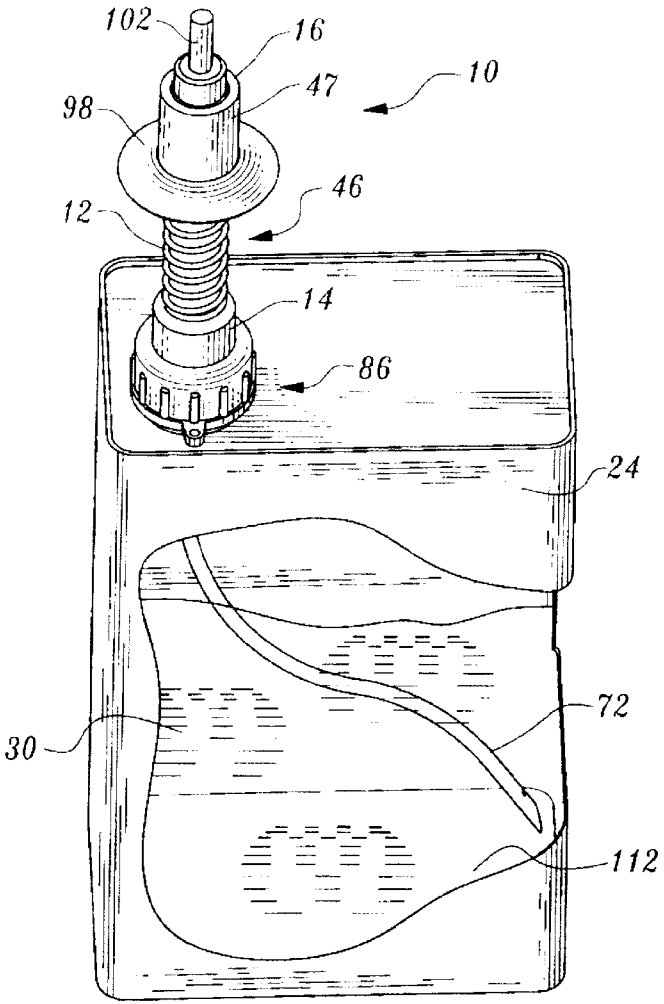
FIG. 5 is a perspective, partially cut-away view of a nozzle and container combination according to a preferred embodiment of the present invention.

Referring to FIGS. 5 and 6, the container 24 and nozzle 10 combination shown therein is first tilted, and the nozzle 10 inserted into the opening 26 of receiving vessel 28, as shown in FIG. 1. Here, the retractable cover 47 is in its default mode, covering orifices 20 and 40 of the nozzle body thereby substantially preventing spills during and after the inversion of the container 24 and the insertion of the nozzle 10 into the opening 26 of the receiving vessel 28. Thereafter, the container 24 is pressed down such that spring 58 on the nozzle 10 is compressed by virtue of the retractable cover 47 being slid away from orifices 20 and 40. Once the outlet orifice 20 is exposed, the first fluid 30 begins being dispensed into receiving vessel 28 through inlet orifice 18, pathway 36 and outlet orifice 40.

More precisely, the vent inlet orifice 40, being closer to the insertion end 16, is first uncovered. The associated second fluid 36 pathway inside the nozzle 10 is typically initially full of the first fluid 30. When the vent inlet orifice 40 is opened the weight of the first fluid 30 causes backfill of the first fluid 30 out of the vent inlet orifice 40 and into the receiving vessel 28. Typically, this back flow occurs until the second fluid 36 pathway is cleared of the first fluid 30. Next, the first fluid 30 begins to flow out of the outlet orifice 20 of the nozzle 10.

After an initial period during which the first fluid 30 is being dispensed into the receiving vessel 28 through the outlet orifice 20 without any of the second fluid 36, such as air and/or vapors being admitted into the container 24, the pressure of the second fluid 36 in the container 24 is sufficiently reduced and the pressure of the second fluid in the receiving vessel is sufficiently increased to clear the tube 72 of any possible remaining liquids and induce a venting of the second fluid 36 from the receiving vessel 28 through vent inlet orifice 40, pathway 44, vent outlet orifice 42, venting tube 72 and vent discharge opening 34 of the venting device 32. This second fluid 36 pathway can be considered a "venting path," a "vent," a "route," or a "venting device," with these terms not limited only to the specific structure disclosed, but rather to describe any appropriate structure capable of carrying the second fluid 36 from the receiving vessel 28 to the container 24.

Preferably, a sound is generated during venting of the second fluid 36 into the container 24, such as by the provision of the whistle 82 at the tip 80 of elongated venting tube 72. The venting device 32 in this way allows an even-flowing transfer of the first fluid 30 from the container 24 into the receiving vessel 28. Advantageously, because the tip 80 of elongated venting tube 72 is disposed in a pocket 110 of the second fluid 36 in the container, the second fluid 36 is vented into the receiving vessel 28 without traversing the first fluid 30 in the container 24 substantially during an entire time for a dispensing of the first fluid 30 from the container 24 into the receiving vessel 28.

The venting, as shown in FIG. 2, continues, until the level of the first fluid 30 in the receiving vessel 28 is such that it covers vent inlet orifice 40 and outlet orifice 20 of nozzle body 12, thus halting the flow of both fluids between the container 24 and the receiving vessel 28. Where, as shown in FIGS. 1 through 3, the vent inlet orifice 40 is disposed further toward the insertion end 16 of the nozzle body 12 than the outlet orifice 20, the whistling through whistle 78 stops just before the first fluid stops flowing into the receiving vessel. Also, the fluid flow is stopped with the level of the first fluid 30 sufficiently below the opening 26 into the receiving vessel 28 to keep the first fluid 30 from spilling out of the opening 26 when the nozzle 10 is removed or the first fluid 30 expands (i.e. due to heating) within the receiving vessel 28.

Attachment mechanism 86, including O-ring 92, allows a sealing attachment of the nozzle body 12 to the opening 22 of the container 24 for substantially preventing the first fluid 30 and the second fluid 36 from escaping at the opening 22 of the container 24. Additionally, seal 98, preferably made of rubber, is compressed when the nozzle 10 is inserted into the opening 26 of the receiving vessel 28, thereby allowing a sealing insertion of the nozzle 10 into the opening 26 of the receiving vessel 28 for substantially preventing at least the second fluid 36 from escaping at the opening 26 of the receiving vessel 28.

After the level of the first fluid 30 has reached the orifices 20 and 40 of the nozzle body 12, the nozzle 10 may be removed from the opening 26 of the receiving vessel 28, after which the retractable cover 47 is repositioned over the outlet orifice 20 and the vent inlet orifice 40 of the nozzle body 12 for closing the outlet orifice 20 and the vent inlet orifice 40 of the nozzle body 12 during the step of removing, thereby advantageously preventing further spills.

Referring now to FIGS. 5 and 6, a combination is shown of a container 24 such as a fuel container 24 to which a nozzle 10 according to the preferred embodiment of the invention and described in relation to FIGS. 1 through 3 has been attached. FIG. 5 shows the container 24 as being upright, while FIG. 6 shows the container 24 as having been tilted and the nozzle 10 as having been inserted into opening 26 of the receiving vessel 28, a pushing forward of the container onto opening 26 having actuated retractable cover 47 to open outlet orifice 20 and vent inlet orifice 40 at the proximal end 16 of nozzle body 12. The elongated tube 72 is shown in FIGS. 5 and 6 as extending diagonally within the container 24 such that a free end or tip 80 of the elongated tube 72 is disposed at an inner edge 112 of the container. The above arrangement of the elongated tube 72 as shown in FIGS. 5 and 6 permits the second fluid 36, such as air and fuel vapors, to be vented from receiving vessel 28 into the container 24 almost always in a pocket 110 of the second fluid 36 in the container 24, such as in an air and vapor pocket, such that the second fluid 36 is vented into the container 24 without traversing the first fluid 30 in the container 24 substantially during an entire time for a dispensing of the first fluid 30 from the container 24 into the receiving vessel 28. Preferably, the elongated tube is made of a flexible material such as a polymeric hydrocarbon which does not degrade when in contact with typical hydrocarbon fuels, as is known in the art. Advantageously, the flexibility of the elongated tube 72 allows the same to bend over to an inner edge 112 of container 24 during an attachment of the nozzle 10 to the container 24 substantially without any further adjustments needing to be made to the elongated tube in order to position the same in the desired manner.

The present invention further includes within its scope a nozzle 10 comprising means for dispensing a first fluid 30 from a container 24 into a receiving vessel 28; and means for venting a second fluid 36 from the receiving vessel 28 into the container 24 such that the second fluid 36 is vented into the container 24 without traversing the first fluid 30 in the container 24, substantially during an entire time for a dispensing of the first fluid 30 from the container 24 into the receiving vessel 28, the above means being substantially shown and described in relation to FIGS. 1, 2, 3, 4 and 5 above.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. Accordingly, it is intended by the appended claims to cover all modifications of the invention which fall within the true spirit and scope of the invention.

What is claimed is:

1. A vapor recovery nozzle comprising in combination:

a liquid path having a first end and a second end;

a vapor path having an entrance end and an exit end;

a nozzle body supporting both said liquid path and said vapor path, said nozzle body having an insertion end and a proximal end, said first end of said liquid path and said entrance of said vapor path located closer to said insertion end than to said proximal end, said second end and said exit end located closer to said proximal end than to said insertion end;

said exit end of said vapor path extending further from said insertion end of said nozzle body than said second end of said liquid path; and wherein a flexible tube is included on said vapor path adjacent said exit end, a length of said flexible tube sufficient to locate said exit end of said vapor path greater than halfway into a depth of the container.

2. The nozzle of claim 1 wherein a whistle is included on said vapor path.

3. The nozzle of claim 1 wherein said entrance end of said vapor path is located closer to said insertion end of said nozzle body than a distance between said first end of said liquid path and said insertion end of said nozzle body.

4. A nozzle comprising:

means for dispensing a first fluid from a container into a receiving vessel;

means for venting a second fluid from the receiving vessel into the container such that the second fluid is vented into the receiving vessel without traversing the first fluid in the container substantially during an entire time for a dispensing of the first fluid from the container into the receiving vessel;

wherein said venting means includes an opening for the second fluid to exit the nozzle which extends further into the container than an opening for the first fluid to enter the nozzle; and wherein said venting means includes a vent path extending through a nozzle body primarily outside of the container and a flexible tube primarily within the container, the flexible tube extending from the nozzle body to the opening for the second fluid to exit the nozzle.

5. The nozzle of claim 4 wherein said flexible tube has a length greater than half of a depth of the container when the container is inverted for pouring the first fluid out of the container and into the receiving vessel.

6. The nozzle of claim 5 wherein the flexible tube includes a whistle thereon, the whistle located closer to the opening for the second fluid to exit the nozzle than to the nozzle body.

7. The nozzle of claim 6 wherein the dispensing means include a first fluid path extending through the nozzle body, such that the nozzle body includes both the dispensing means for the first fluid and at least a portion of the venting means for the second fluid.

* * * * *